United States Patent [19]

Leedom

[11] 4,084,691

[45] Apr. 18, 1978

[54] VIDEO DISC PACKAGE

[75] Inventor: Marvin Allan Leedom, Princeton, N.J.

[73] Assignee: RCA Corporation, New York, N.Y.

[21] Appl. No.: 747,730

[22] Filed: Dec. 6, 1976

[51] Int. Cl.[2] ..... B65D 85/30

[52] U.S. Cl. ..... 206/313; 206/444

[58] Field of Search ..... 206/303, 307, 309, 312–313, 206/387, 444

[56] References Cited

U.S. PATENT DOCUMENTS

| | | | |
|---|---|---|---|
| 3,422,952 | 1/1969 | George | 206/313 |

FOREIGN PATENT DOCUMENTS

| | | | |
|---|---|---|---|
| 2,271,632 | 12/1975 | France | 206/312 |
| 1,312,778 | 4/1973 | United Kingdom | 206/313 |
| 1,055,964 | 1/1967 | United Kingdom | 206/312 |
| 1,410,020 | 10/1975 | United Kingdom | 206/313 |

*Primary Examiner*—Steven E. Lipman
*Attorney, Agent, or Firm*—Eugene M. Whitacre; William H. Meagher; Dilip A. Kulkarni

[57] ABSTRACT

A video disc package comprises a pair of juxtaposed panels defining a cavity for enclosing a video disc and an edge opening in communication with the cavity for permitting insertion and removal of a video disc into and from the cavity. The panels have portions forming a constricted passage between the cavity and the opening. The constricted passage forming portions of the panels are covered with material effecting a cleaning of a video disc each time it is inserted into the package or removed therefrom.

13 Claims, 14 Drawing Figures

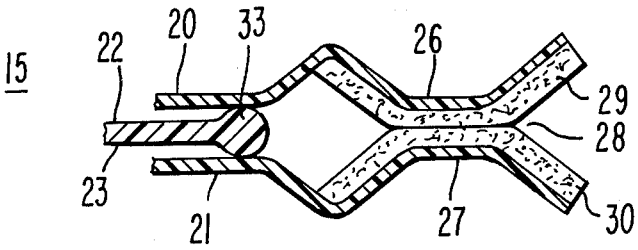
Fig. 4.
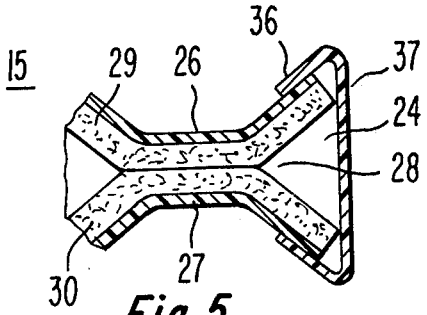
Fig. 5.
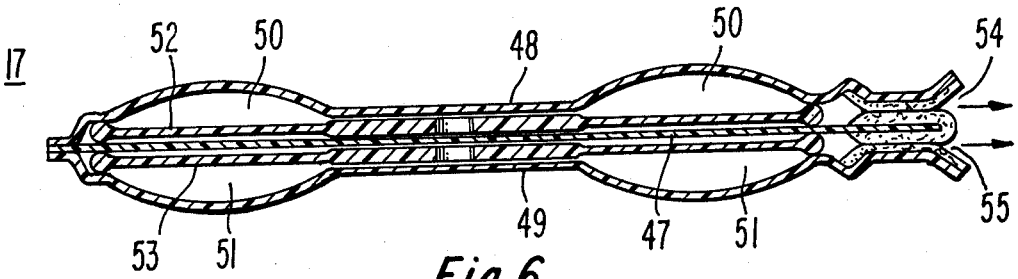
Fig. 6.
Fig. 7.
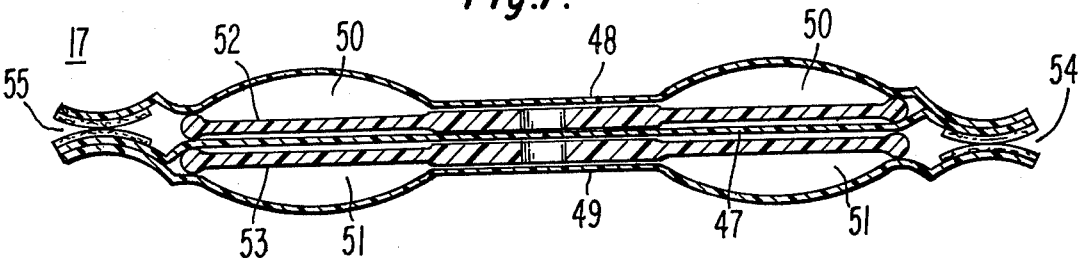
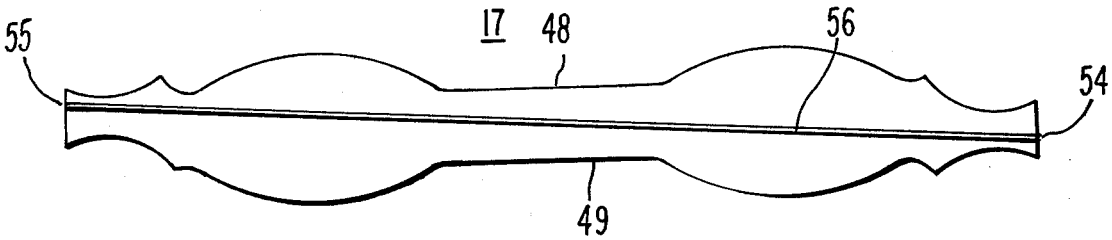
Fig. 7a.

VIDEO DISC PACKAGE

The invention relates to a video disc system, and, more particularly, it relates to a novel package for a video disc.

In the U.S. Pat. No. 3,842,194, issued to Jon K. Clemens, a video disc system is disclosed. In an arrangement therein disclosed, an information track consists of geometric variations in the bottom of a smooth spiral groove on the surface of a disc record. The disc record has a deposit of dielectric material overlying a coating of conductive material. During playback, variations in the capacitance formed between an electrode incorporated in a groove-riding stylus and the conductive coating of the disc record are sensed as it is rotated by a supporting turntable to reconstruct the recorded information.

In the systems of the Clemens type, in order to obtain adequate playing time, the successive groove convolutions are relatively closely space on the surface of the video disc (e.g., 4.5 micrometers—corresponding to a groove density of 5,555 gpi) and the signal elements in the groove bottom are relatively small (e.g., signal element length — 0.3 to 0.8 micrometers and signal element depth of 0.10 to 0.15 micrometers).

The accumulation of dust on such video discs presents a considerable problem. The problem of dust accumulation is especially serious when the exposure of a video disc to the atmospheric dust is accompanied by the conditions of high temperature and high humidity. It is therefore advantageous to provide a package which completely encloses a video disc in a dust-proof environment during its storage and handling.

The video discs of the type described above are prone to damage during their manual handling (e.g., scratches, fingerprints, etc). It is therefore desirable to provide a package which permits insertion and withdrawal of an enclosed video disc into and from a playback device without the need for removing the enclosed video disc from its protective package.

It has been found that wiping of a video disc with soft material (e.g., velvet) prior to playback is useful as it results in a significant reduction in signal dropouts during playback.

In accordance with the present invention, a package for a disc record comprises a pair of juxtaposed panels defining a cavity for enclosing a disc record and an edge opening in communication with the cavity for permitting insertion and removal of a disc record into and from the cavity. The panels have portions which define a constricted passage interposed between the opening and the cavity. The constricted passage forming portions of the panels are covered with material effecting a wiping of a disc record during its insertion into and removal from its package.

Pursuant to another feature of the invention, the package includes a detent for engaging the bead of an enclosed disc record to prevent its accidental removal from the package.

According to still another feature of the invention, the panels have recessed interior surfaces defining a toroidal region of the cavity which is positoned so that, when a disc record is enclosed in the cavity, the disc record is suspended between the panels without contact therewith.

In accordance to a further feature of the invention, a novel multi-record package is disclosed.

In the accomapanying drawings:

FIG. 1 is a plan view of a video disc package pursuant to the principles of the present invention;

FIGS. 2 and 3 are cross-sections of the package of FIG. 1 taken along the lines 2—2 and 3—3 respectively in FIG. 1;

FIG. 4 shows the constricted passage forming portion of the package of FIG. 1;

FIG. 5 illustrates a retaining cap for sealing the open edge of the package of FIG. 1;

FIGS. 6 and 7 depict embodiments of a two record package also pursuant to the present invention;

Figure 1:
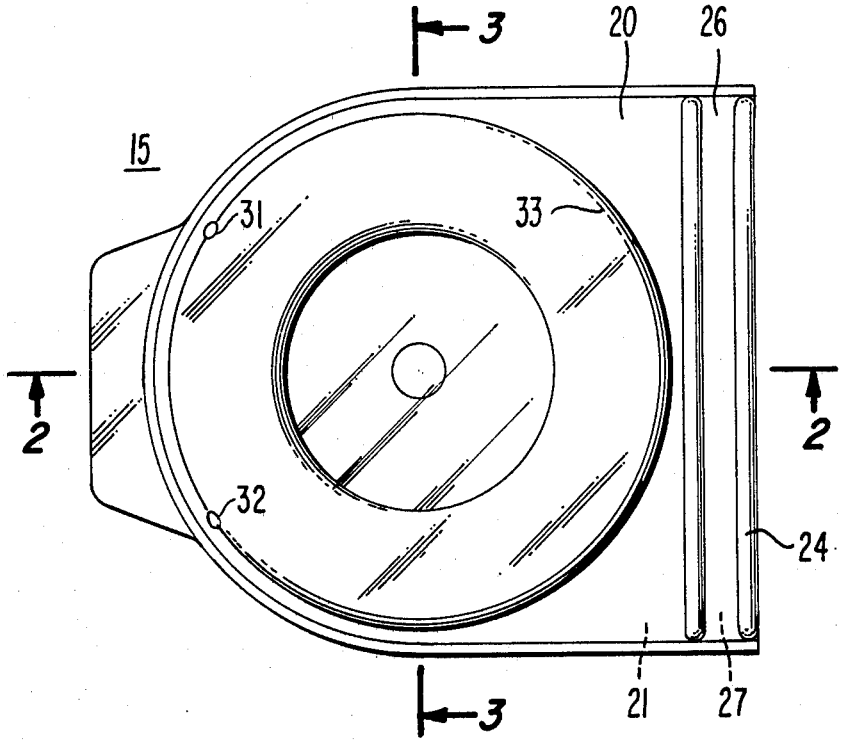
Figure 8:
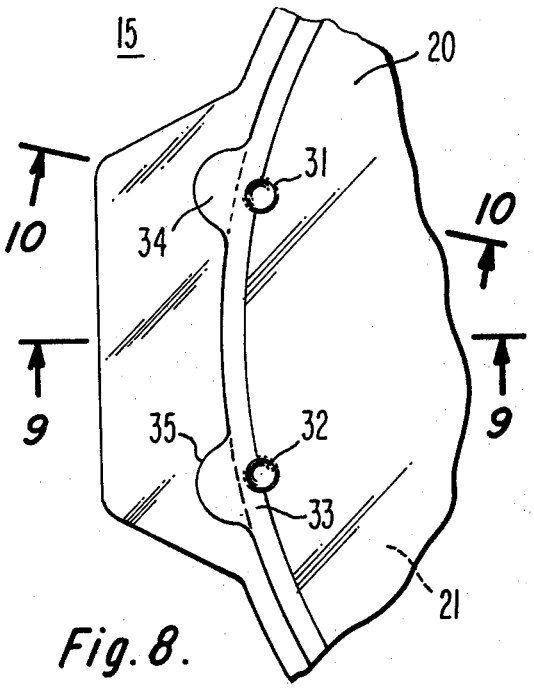
Figure 11:
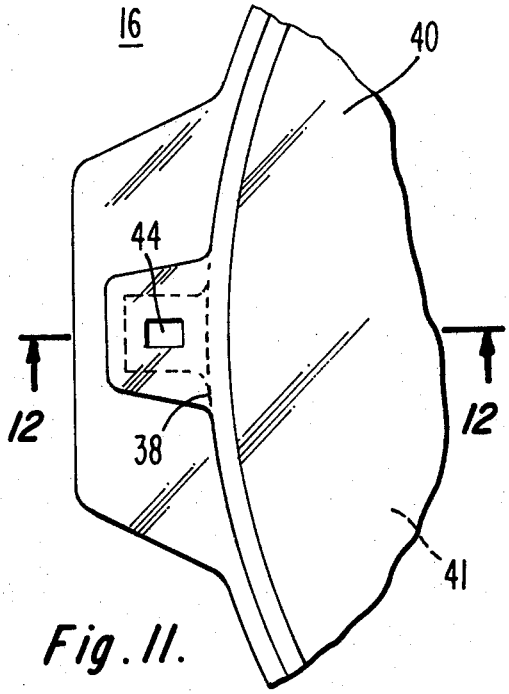
Figure 9:
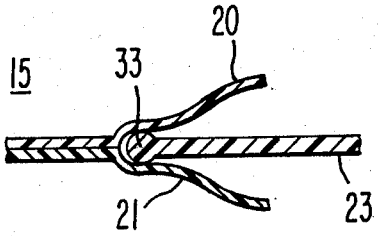
Figure 12:
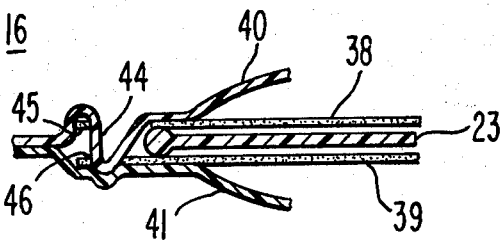
Figure 10:
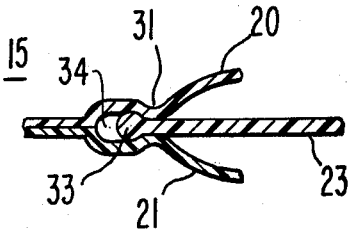
Figure 13:
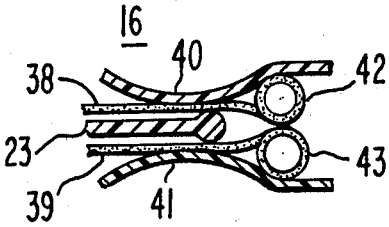

FIG. 7*a* shows a side view of the package of FIG. 7;

FIG. 8 illustrates detents for securing an enclosed video disc in the package of FIG. 1;

FIGS. 9 and 10 are cross-sections of the package of FIG. 8 taken along the lines 9—9 and 10—10 respectively in FIG. 8;

FIG. 11 shows still another embodiment of the package according to the present invention where a pair of liners are sandwiched between the panels to form a sleeve for protecting the enclosed video disc;

FIG. 12 illustrates a cross-section of the package of FIG. 11 taken along the line 12—12 in FIG. 11; and FIG. 13 shows details of the open edge of the package of FIG. 11.

Figure 2:
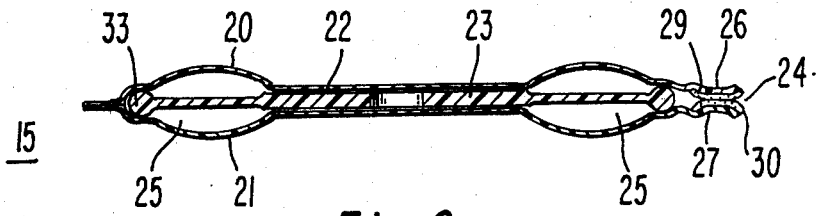
Figure 3:
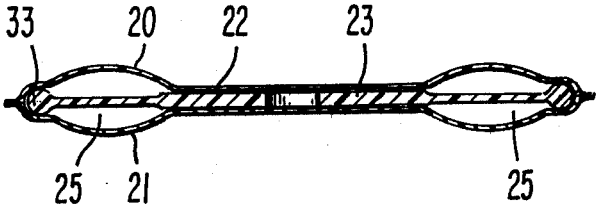

Referring to FIGS. 1, 2 and 3, the video disc package 15 comprises a pair of juxtaposed panels 20 and 21 made from any suitable material (e.g., polystyrene). The juxtaposed panels define a cavity 22 for enclosing a video disc 23 in a dust-proof environment. The panels 20 and 21 are joined together over less than their entire peripheral edges. The unjoined portions of the panels 20 and 21 define an edge opening 24 in communication with the cavity 22 for permitting insertion and removal of a video disc into and from the package.

The interior surfaces of the panels 20 and 21 are outwardly recessed to define a toroidal region 25 of the cavity 22. The inner diameter of the toroidal region 25 is made not greater than the inner diameter of the recoded portion of the video disc 23 and the outer diameter of the toroidal region is made not less than the outer diameter of the recorded portion of the video disc. The toroidal region 25 is so positioned that an enclosed vidio disc is suspended between the panels without contact therewith. Such an arrangement protects the recorded portion of a video disc and adds stiffness to the package.

As illustrated in more detail in FIG. 4, the panels 20 and 21 have portions 26 and 27 which define a constricted passage 28 interposed between the record enclosing cavity 22 and the opening 24. A pair of pads 29 and 30, made from suitable soft material (e.g., velvet), are secured to the interior surfaces of the constricted passage forming portions 26 and 27 of the panels 20 and 21 to effect a wiping of a video disc during its insertion into and removal from the package. Other suitable materials for the wiping pads are lintless, non-woven polyester paper made by Dupont, and polyurethane foam made by Scott Paper Co., Foam Division. It will be seen that the wiping pads 29 and 30 are rolled away from the constricted passage 28 so as to keep the edges of the wiping pads from contacting a video disc during its insertion into and removal from its package. As indicated previously, the wiping of a video disc prior to playback significantly improves its performance during playback.

The unjoined peripheral edges of the panels 20 and 21 are outwardly flared to facilitate insertion and removal of a video disc into and from the package.

The package may be manufactured by using any suitable process—e.g., injection molding, trap molding, vacuum forming, etc.

The package 15 is suitable for use with a system which permits insertion and removal of an enclosed video disc into and from a playback device without the direct handling of the video disc by the user. Such systems are disclosed in concurrently filed U.S. applications of C. F. Coleman and M. A. Leedom entitled, respectively, "VIDEO DISC INSERTION/EXTRACTION SYSTEM FOR A VIDEO DISC PLAYER " and "VIDEO DISC HANDLING SYSTEM FOR A VIDEO DISC PLAYER."

In accordance with Leedom and Coleman approach, a package contains a video disc is inserted into a player through an input slot provided in the player housing. During the insertion of the package into the player, an appropriately designed platform leads it to a fully inserted position such that a clamping device mounted in the player protrudes into the package. The clamping device then precludes a removal of the video disc during the cover withdrawal to permit the video disc to remain in the player resting on the platform.

When the lid of the player is lowered, the platform is depressed to effect a transfer of the video disc resting thereon to the player turntable for playback. After playback, the lid is raised to lift the video disc to the level of the input slot. During the insertion of an empty package into the player through the input slot, the video disc is automatically returned to the package. After a full insertion of the package into the player, the package is removed along with the enclosed video disc.

In the afore-mentioned systems, it is desirable to prevent a removal of the package from the player while a video disc is only partly enclosed therein. To this end, as shown in FIGS. 8, 9 and 10, the video disc package is provided with a pair of detents 31 and 32. The detents 31 and 32 engage the bead 33 of the video disc 23 only when it is fully enclosed in the package 15. Relief areas 34 and 35 are provided around the depressions defining the detents 31 and 32 to allow the panels to flex easily without breaking the joint interconnecting the panels 20 and 21. The detents 31 and 32 additionally serve to preclude accidental removal of an enclosed video disc from the package.

FIG. 5 shows a retaining cap 36 for sealing the open edge of the package 15. The retaining cap 36 blocks the dirt from getting into the package, adds stiffness to the package and also serves to protect the shape of the unjoined portions of the panels 20 and 21 which define the flared opening. The retaining cap 36 is removed before insertion of the package into the player. To help insure that the consumer does not discard the cap, the edge 37 of the retaining cap may be labeled to make a nice display on a book case.

As shown in FIGS. 11, 12 and 13, a pair of soft liners 38 and 39 (e.g., made from non-woven, lintless polyester paper) are inserted in the package to form a sleeve between the panels 40 and 41, pursuant to another embodiment 16 of the present invention. The liners 38 and 39 have portions 42 and 43 which are outwardly rolled as shown in FIG. 13. The construction of the package 16 is such that the outwardly rolled portions 42 and 43 are seated in the funnel-shaped opening of the package to provide a dust barrier upon securing of the liners 38 and 39 within the package. The outwardly rolled portions 42 and 43 of the liners 38 and 39 additionally serve as the wiping pads.

As shown in FIGS. 11 and 12, the securing of the liners 38 and 39 to the package is achieved by a tab 44 formed in the panel 40 which is received in the apertures 45 and 46 provided in the liners upon a seating of the outwardly rolled portions 42 and 43 in the funnel-shaped opening of the package.

An advantage of the above-described sleeve arrangement is that the outer surfaces of the liners can be printed to provide a nice display when the panels are made of transparent material.

FIGS. 6 and 7 show two embodiments of a two record package 17 pursuant to the present invention. As illustrated therein, a center partition 47 is interposed between the two external panels 48 and 49 to define two record enclosing cavities 50 and 51. In the embodiment of FIG. 6, the openings 54 and 55 in the package 17 are located at the same end of the package. However, in the embodiment of FIG. 7, the openings 54 and 55 in the package are located at opposite ends of the package.

The player designed for handling the two record package of the type shown in FIG. 6 may be provided with two clamping devices, the appropriate one of which is activated by the package upon its full insertion into the player to select the respective one of the discs.

The player designed to handle the two record package of the type shown in FIG. 7 may be provided with only one clamping device. As can be seen from FIG. *7a*, a ledge portion 56 provided in the two record package of the type shown in FIG. 7, for guiding the package during its insertion into the player, is angled to pass through the center lines of the two openings on the opposite sides of the package so that each opening aligns with the clamping device upon the insertion of the package into the player. Such player would be suitable for playing one record albums as well as two record albums.

The foregoing is considered as illustrative only of the principles of the present invention. Further, since numerous modifications and changes will readily occur to those skilled in the art, it is not desired to limit the invention as to the exact construction and operation shown and described, and accordingly, all suitable modifications and equivalents may be resorted to provided they fall within the scope of the invention as claimed.

What is claimed is:

1. A package for a disc record comprising:

a pair of juxtaposed panels defining a cavity for enclosing said disc record;

said panels being joined together along less than their entire peripheral edges; the unjoined peripheral edges of said panels defining an opening in communication with said cavity to permit the insertion and removal of said disc record into and from said cavity; and a pair of wiping pads; each one of said wiping pads being secured to the respective one of said panels in the region thereof interposed between said record enclosing cavity and said opening in such manner that said wiping pads lie entirely outside said record enclosing cavity, whereby a record enclosed in said cavity does not contact said wiping pads; said wiping pads defining a passage which is constricted relative to said record enclosing cavity.

2. A package as defined in claim 1 wherein said unjoined peripheral edges of said panels are outwardly flared so that said opening has a funnel-shape to facilitate said insertion and removal.

3. A package as defined in claim 2 wherein each of said wiping pads has an intermediate portion disposed between interior and exterior edges thereof; wherein said interior and said exterior edges of each of said wiping pads are flared with respect to said intermediate portions so as to prevent contact between said interior and exterior edges and the recorded portions of a disc record during the insertion and removal thereof into and from said cavity.

4. A package as defined in claim 1 further including a dust excluding cap which slips over the unjoined peripheral edges of said panels.

5. A package as defined in claim 1 for use with a disc record having outer peripheral surfaces defining a bead, wherein at least one of said panels has a detent for engaging said disc record bead when said disc record is fully enclosed in said cavity to secure said disc record in said package.

6. A package for a disc record comprising:

a pair of juxtaposed panels defining a cavity for enclosing said disc record;

said panels being joined together along less than their entire peripheral edges; the unjoined peripheral edges of said panels defining an opening in communication with said cavity to permit the insertion and removal of said disc record into and from said cavity;

said panels having portions which form a passage disposed between said opening and said record enclosing cavity;

said passage forming portions of said panels being covered with wiping material disposed so that said wiping material lies entirely outside said record enclosing cavity; said wiping material effecting a cleaning of said disc record during said insertion and removal; and wherein each of said panels has a recessed inner surface defining said cavity; the construction of said recessed inner surfaces of said panels being such that said cavity includes a region of toroidal shape, having an inner diameter not greater than the inner diameter of the recorded portion of a disc record and having an outer diameter not less than the outer diameter of the recorded portion of said disc record, positioned so that, when said disc record is enclosed in said cavity, said recorded portion of said disc record is suspended between said panels without contact therewith.

7. A package as defined in claim 6 wherein said panels have dome-shaped outer surfaces which conform to said inner surfaces defining said toroidal region.

8. A package for a disc record comprising:

a pair of juxtaposed panels defining a cavity for enclosing said disc record;

said panels being joined together along less than their entire peripheral edges; the unjoined peripheral edges of said panels defining an opening in communication with said cavity to permit the insertion and removal of said disc record into and from said cavity; wherein said unjoined peripheral edges of said panels are outwardly flared so that said opening has a funnel shape to facilitate said insertion and removal;

said panels having portions which form a constricted passage disposed between said opening and said disc record enclosing cavity; and a pair of liners forming a sleeve between said panels; each of said liners having a portion with is outwardly rolled; the construction of said package being such that said outwardly rolled portions of said liners are seated in said funnel-shaped opening of said package to provide a dust barrier upon securing of said liners within said package; said outwardly rolled portions of said liners additionally serving to effect a wiping of said disc record during said insertion and removal.

9. A package for a disc record comprising:

a pair of juxtaposed panels defining a cavity for enclosing said disc record;

said panels being joined together along less than their entire peripheral edges; the unjoined peripheral edges of said panels defining an opening in communication with said cavity to permit the insertion and removal of said disc record into and from said cavity; wherein said unjoined peripheral edges of said panels are outwardly flared so that said opening has a funnel shape to facilitate said insertion and removal;

said panels having portions which form a constricted passage disposed between said opening and said disc record enclosing cavity; and a pair of liners forming a sleeve between said panels; each of said liners having a portion which is outwardly rolled; the construction of said package being such that said outwardly rolled portions of said liners are seated in said funnel-shaped opening of said package to provide a dust barrier upon securing of said liners within said package; said outwardly rolled portions of said liners additionally serving to effect a wiping of said disc record during said insertion and removal;

wherein said securing of said liners to said package is achieved by a tab provided in one of said panels which is received in apertures provided in said liners when said outwardly rolled portions of said liners are seated in said funnel-shaped opening.

10. A package for storing a set of two disc records comprising:

a pair of panels;

a partition interposed between said panels;

each of said panels defining in cooperation with said partition a respective cavity for enclosing a disc record;

said package having a pair of openings; each of said openings being defined by an edge of said partition and an edge of a respective one of said panels; and each of said openings being in communication with a respective one of said cavities to permit the insertion and removal of a disc record from the respective cavity;

each of said panels having a portion which forms in cooperation with an adjacent portion of said partition a passage interposed between a respective one of said openings and a respective one of said cavities; and a plurality of wiping pads; a wiping pad being secured to each one of said passage forming portions of said partition and said panels in such manner that said wiping pads lie entirely outside said record enclosing cavities, whereby records enclosed in said cavities do not contact the respective ones of said wiping pads; each one of said wiping pads forming a passage in conjunction with an adjacent wiping pad which is constricted relative to a respective one of said record enclosing cavities.

11. A package as defined in claim 10 wherein said openings in said package are at the same end of said package.

12. A package for storing a set of two disc records comprising:

a pair of panels;

a partition interposed between said panels;

each of said panels defining in cooperation with said partition a respective cavity for enclosing a disc record;

said package having a pair of openings; each of said openings being defined by an edge of said partition and an edge of a respective one of said panels; and each of said openings being in communication with a respective one of said cavities to permit the insertion and removal of a disc record from the respective cavity;

each of said panels having a portion which forms in cooperation with an adjacent portion of said partition a passage interposed between a respective one of said openings and a respective one of said cavities; and a plurality of wiping pads; a wiping pad being secured to each one of said passage forming portions of said partition and said panels in such manner that said wiping pads lie entirely outside said record enclosing cavities, whereby records enclosed in said cavities do not contact the respective ones of said wiping pads; each one of said wiping pads forming a passage in conjunction with an adjacent wiping pad which is constricted relative to a respective one of said record enclosing cavities;

wherein said openings in said package are at the opposite ends of said package.

13. A package as defined in claim 12 wherein said package has ledge portions for locating the package in a playback device; said ledge portions being angled to pass through the respective center lines of said openings on the opposite sides of said package.

* * * * *

UNITED STATES PATENT AND TRADEMARK OFFICE
CERTIFICATE OF CORRECTION

PATENT NO. : 4,084,691

DATED : April 18, 1978

INVENTOR(S) : Marvin Allan Leedom

It is certified that error appears in the above-identified patent and that said Letters Patent is hereby corrected as shown below:

Column 1, line 63, that portion reading "positoned" should read --positioned--; Column 2, line 1, that portion reading "accomapanying" should read --accompanying--; Column 2, lines 41 & 42, that portion reading "recoded" should read --recorded--; Column 2, line 45, that portion reading "vidio" should read --video--; Column 3, line 18, that portion reading "contains" should read --containing--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*